US007566423B2

(12) United States Patent
Evans-Beauchamp

(10) Patent No.: US 7,566,423 B2
(45) **Date of Patent: *Jul. 28, 2009**

(54) AIR PURIFICATION SYSTEM EMPLOYING PARTICLE BURNING

(75) Inventor: Lincoln Evans-Beauchamp, Palo Alto, CA (US)

(73) Assignee: Purify Solutions, Inc., Redwood City, CA (US)

( * ) Notice: Subject to any disclaimer, the term of this patent is extended or adjusted under 35 U.S.C. 154(b) by 453 days.

This patent is subject to a terminal disclaimer.

(21) Appl. No.: 11/412,289

(22) Filed: Apr. 26, 2006

(65) Prior Publication Data

US 2007/0254250 A1 Nov. 1, 2007

(51) Int. Cl.
*F01N 3/10* (2006.01)

(52) U.S. Cl. ..... 422/173; 422/168

(58) Field of Classification Search ..... 422/168, 422/173; 423/215.5

See application file for complete search history.

(56) References Cited

U.S. PATENT DOCUMENTS

| | | | |
|---|---|---|---|
| 2,418,191 | A | 4/1947 | Parrish |
| 3,086,353 | A | 4/1963 | Ridgway |
| 3,148,442 | A | 9/1964 | Gier |
| 3,165,152 | A | 1/1965 | Jones |
| 3,775,971 | A | 12/1973 | Gadefelt |
| 3,912,464 | A | 10/1975 | Schulz |
| 4,312,321 | A | 1/1982 | Skow |
| 4,338,998 | A | 7/1982 | Goloff |
| 4,524,587 | A | 6/1985 | Kantor |
| 4,976,310 | A | 12/1990 | Jabs |
| 5,179,259 | A | 1/1993 | Martin |
| 5,335,492 | A | 8/1994 | Zirkel |
| 5,450,721 | A | 9/1995 | Golben et al. |
| 5,987,885 | A | 11/1999 | Kizer et al. |
| 6,119,457 | A | 9/2000 | Kawamura |
| 6,238,815 | B1 | 5/2001 | Skala et al. |
| 6,360,532 | B2 | 3/2002 | Strahle et al. |
| 6,381,955 | B1 | 5/2002 | Morganti et al. |
| 6,390,185 | B1 | 5/2002 | Proeschel |
| 6,422,077 | B1 | 7/2002 | Hartick |
| 6,488,079 | B2 | 12/2002 | Zifferer |

(Continued)

FOREIGN PATENT DOCUMENTS

| | | |
|---|---|---|
| JP | 2000282841 | 10/2000 |

(Continued)

OTHER PUBLICATIONS

U.S. Appl. No. 11/404,424, Lincoln Evans-Beauchamp, Particle Burning in an Exhaust System, filed Apr. 14, 2006.

(Continued)

*Primary Examiner*—Edward M Johnson
(74) *Attorney, Agent, or Firm*—Carr & Ferrell LLP

(57) ABSTRACT

An air purification system includes a reverse flow heat exchanger, a combustion chamber and a means for heating particles configured to cause particles in air to combust in the chamber. The reverse flow heat exchanger transfers excess heat from the purified air to the incoming air to lower the amount of energy needed to combust the particles in the combustion chamber. The means for heating particles can comprise a flame or a microwave emitter. The reverse flow heat exchanger is spiral wound around the combustion chamber.

8 Claims, 9 Drawing Sheets

U.S. PATENT DOCUMENTS

| | | | |
|---|---|---|---|
| 6,708,485 | B2 | 3/2004 | Hinder et al. |
| 6,865,883 | B2 | 3/2005 | Gomulka |
| 6,983,105 | B1 | 1/2006 | Greene |
| 7,266,943 | B2 | 9/2007 | Kammel |
| 2003/0230059 | A1 | 12/2003 | Nixdorf |
| 2004/0065013 | A1 | 4/2004 | DeVries |
| 2004/0118111 | A1 | 6/2004 | Covit |
| 2005/0252202 | A1 | 11/2005 | Page |
| 2006/0260297 | A1 | 11/2006 | Koch |
| 2007/0251222 | A1* | 11/2007 | Evans-Beauchamp ..... 60/298 |

FOREIGN PATENT DOCUMENTS

| | | |
|---|---|---|
| JP | 2003193832 | 7/2003 |
| JP | 2005-299474 | 10/2005 |
| WO | WO9915466 | 4/1999 |

OTHER PUBLICATIONS

U.S. Appl. No. 11/412,481, Lincoln Evans-Beauchamp, Reverse Flow Heat Exchanger for Exhaust Systems, filed Apr. 26, 2006.

* cited by examiner

AIR PURIFICATION SYSTEM EMPLOYING PARTICLE BURNING

CROSS-REFERENCE TO RELATED APPLICATIONS

This application is related to U.S. Non-Provisional patent application Ser. No. 11/404,424 filed Apr. 14, 2006 and entitled "Particle Burning in an Exhaust System". This application is also related to U.S. Non-Provisional patent application Ser. No. 11/412,481 filed Apr. 26, 2006 and entitled "Reverse Flow Heat Exchanger for Exhaust Systems".

BACKGROUND OF THE INVENTION

1. Field of the Invention

This invention relates generally to air purification systems and more particularly to systems for reducing particles in air.

2. Description of the Prior Art

When a fuel burns incompletely, pollutants such as particles and hydrocarbons are released into the atmosphere. The United States Environmental Protection Agency has passed regulations that limit the amount of pollutants that, for example, diesel trucks, power plants, engines, automobiles, and off-road vehicles can release into the atmosphere.

Currently, industries attempt to follow these regulations by adding scrubbers, catalytic converters and particle traps to their exhaust systems. However, these solutions increase the amount of back pressure exerted on the engine or combustion system, decreasing performance. In addition, the scrubbers and particle traps themselves become clogged and require periodic cleaning to minimize back pressure.

Radiation sources and heaters have been used in exhaust systems, for example, to periodically clean the particle traps or filter beds. Others solutions have included injecting fuel into the filter beds or exhaust streams as the exhaust enters the filter beds to combust the particles therein. However, the filter beds can be sensitive to high temperatures and the radiation sources and heaters must be turned off periodically.

Air purification systems currently use one of two methods to remove particles such as dust, biological toxins, and the like from the air in a room. One type of system uses an ionizer to provide a surface charge to the air-borne particles so that they adhere to a surface. However, ionizers emit ozone, a respiratory irritant, into the air. Another type of system uses a filter, such as a HEPA filter, to trap particles as the air flows through the filter. However, filters need to be replaced or cleaned periodically. Both methods require a fan to circulate the air, which requires electricity and can be loud.

SUMMARY OF THE INVENTION

An exhaust system comprises a combustion chamber and a radiation source. The radiation source is arranged with respect to the combustion chamber, either inside or outside of the chamber, so as to be able to produce radiation within the combustion chamber. The radiation source can comprise a resistive heating element, a coherent or incoherent infrared emitter, or a microwave emitter, for example. The microwave emitter can be tuned to a particular molecular bond. Where the radiation source is disposed outside of the combustion chamber, the radiation source can either heat the chamber walls to reradiate into the chamber, else the combustion chamber can include a radiation transparent window.

Particles in an exhaust stream passing through the combustion chamber are heated by the radiation to an ignition point and are consequently removed from the exhaust by burning. Microwave radiation tuned to excite a molecular bond found in the particles can be particularly effective for heating the particles rapidly. Additional air or fuel can be added to the combustion chamber, as needed, to promote better combustion. Once a flame front is established in the combustion chamber, the combustion reaction can become self-sustaining so that further radiation from the radiation source is no longer required.

In some embodiments, the combustion chamber has a non-circular cross-section perpendicular to a longitudinal axis of the chamber. In some of these embodiments, the cross-section is at least partially parabolic to focus heat from the burning particles back into a hot zone within the combustion chamber where the particle burning preferentially occurs. The combustion chamber can be thermally insulated to better retain heat in order to maintain the combustion reaction. The exhaust system can also comprise a thermally insulated exhaust pipe leading to the combustion chamber to further reduce the loss of heat from the exhaust stream before particle burning can occur. In some embodiments, a reverse flow heat exchanger is placed in fluid communication with the combustion chamber so that heat is transferred to the incoming exhaust stream from the combusted exhaust stream exiting the combustion chamber. In certain embodiments, the reverse flow heat exchanger is also thermally insulated.

One advantage of certain embodiments of the present invention is the absence of a particle filter or trap within the combustion chamber. While prior art systems have attempted to trap particles and then periodically clean the trap or filter, these systems create significant back-pressure as such traps and filters obstruct the exhaust flow, especially as they become plugged with particles. Continuously burning the particles in the combustion chamber without the use of such traps or filters provides a more simple design that additionally reduces back-pressure.

A vehicle comprising an internal combustion engine and the exhaust system described above is also provided. The exhaust system can serve as either or both of a muffler and a catalytic converter. Thus, the combustion chamber can also include a catalyst. In some embodiments, the combustion chamber and/or the reverse flow heat exchanger can be sized to act as a resonating chamber to serve as a muffler. For example, the combustion chamber can have a diameter greater than a diameter of the exhaust pipe leading into the combustion chamber. The vehicle can also comprise a controller configured to control the radiation source.

The system described herein can be implemented in a variety of settings where particles are present in a gas stream. Some embodiments include automobile exhaust systems, diesel exhaust systems, power plant emission systems, fireplace chimneys, off-road vehicle exhaust systems, and the like.

An air purification system comprises a spiral reverse flow heat exchanger, including two ducts, spiral-wound around a combustion chamber. The reverse flow heat exchanger draws particle-laden air into the combustion chamber. In the combustion chamber, the particles are burned, which heats the air. The exiting air, substantially particle-free, exits the combustion chamber at an elevated temperature. The reverse flow heat exchanger transfers the heat from the exiting air to preheat the particle-laden air entering the combustion chamber.

In some embodiments, a radiation source is arranged with respect to the combustion chamber so as to produce radiation within the chamber. The radiation source can be, for example, a microwave emitter tuned to excite a molecular bond. The radiation heats the particles sufficiently to initiate a complete combustion reaction.

In other embodiments, a flame is used to burn the particles in the combustion chamber. Accordingly, the combustion chamber includes a fuel inlet and an igniter to light the flame. Suitable fuels include propane and butane. A flame can also be used in combination with the radiation source.

DETAILED DESCRIPTION

An exhaust system comprises a combustion chamber and a radiation source to facilitate the combustion of particles within the chamber. Once ignited, the combustion can continue so long as the concentration of particles in the exhaust entering the chamber remains sufficiently high. The disclosed device can replace both the muffler and the catalytic converter in a vehicle exhaust system and offers reduced back pressure for better fuel economy and lower maintenance costs. The device requires little to no maintenance and is self-cleaning.

Figure 1:
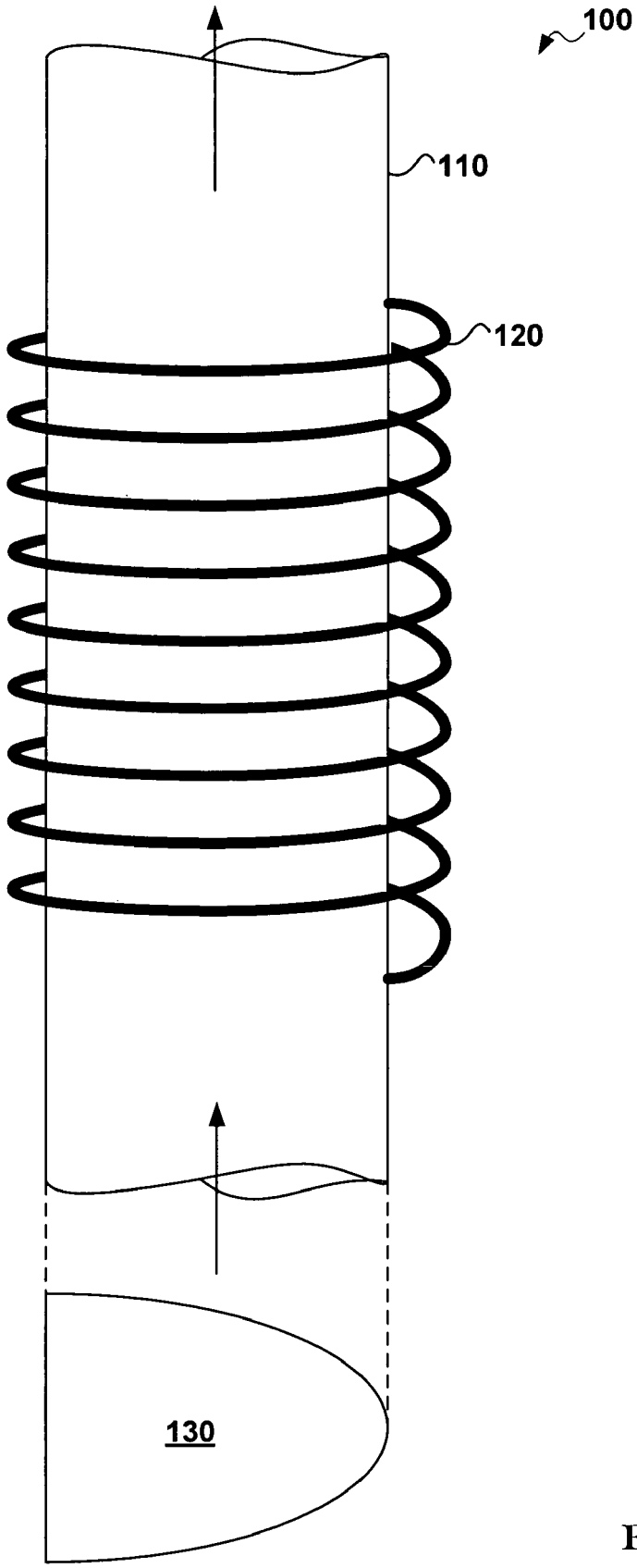
FIG. 1 depicts a system for burning particles in an exhaust system in accordance with one embodiment of the invention.

FIG. 1 depicts an exhaust system 100 comprising a combustion chamber 110 and a radiation source 120. The combustion chamber 110 can be constructed using any suitable material capable of withstanding the exhaust gases at the combustion temperature of the particles. Suitable materials include stainless steel, titanium, and ceramics. In one embodiment, the combustion chamber 110 has a non-circular cross-section 130 perpendicular to a longitudinal axis of the combustion chamber 110. At least a portion of the cross-section 130 can be parabolic in order to focus radiation from the combustion reaction into a hot zone within the combustion chamber 110. It will be appreciated that the combustion chamber 110, in some embodiments, can be proportioned to serve as a resonating chamber so that the combustion chamber 110 also performs as a muffler.

One advantage of certain embodiments of the present invention is the absence of an obstructing particle filter or trap within the combustion chamber 110. A particle trap or filter is obstructing if it would at least partially restrict the flow of an exhaust gas through the combustion chamber 110. By not restricting the flow of exhaust gas through the combustion chamber 110, embodiments of the invention serve to reduce back-pressure compared with prior art systems.

Radiation source 120, in the illustrated embodiment, comprises a resistive heating element wrapped around the outside of the combustion chamber 110. In another embodiment, the radiation source 120 is placed externally along the longitudinal length of the combustion chamber 110. In some embodiments, a controller (not shown) for the radiation source 120 is provided to control the power to the radiation source 120 and to turn off the radiation source 120 when not needed, such as when no exhaust is flowing. Alternative radiation sources are discussed below with reference to FIG. 3.

In operation, an exhaust gas containing particles, such as carbonaceous particles like soot, flows through the combustion chamber 110. The radiation source 120 heats the wall of the combustion chamber 110 which re-radiates infrared (IR) radiation into the interior of the combustion chamber 110. Some of the IR radiation is absorbed by the particles in the exhaust gas as they traverse the combustion chamber 110. When the particles reach a temperature at which they ignite, about 800° C. for carbonaceous particles, the particles burn completely, leaving no residue. Accordingly, essentially particle-free exhaust leaves the combustion chamber 110.

The heat produced by the combustion of the particles can make the continuing reaction self-sustaining so that the radiation source 120 is not necessary. A thermocouple (not shown) can be placed on or in the combustion chamber 110 in order to monitor the temperature of the combustion reaction to provide feedback to a controller (not shown) for controlling the power to the radiation source 120. As noted above, the combustion chamber 110 can be shaped to focus IR radiation from the combustion reaction onto a focal point or line within the combustion chamber 110 to create a hot zone that helps to sustain the continuing reaction in the absence of external heating.

Figure 2:
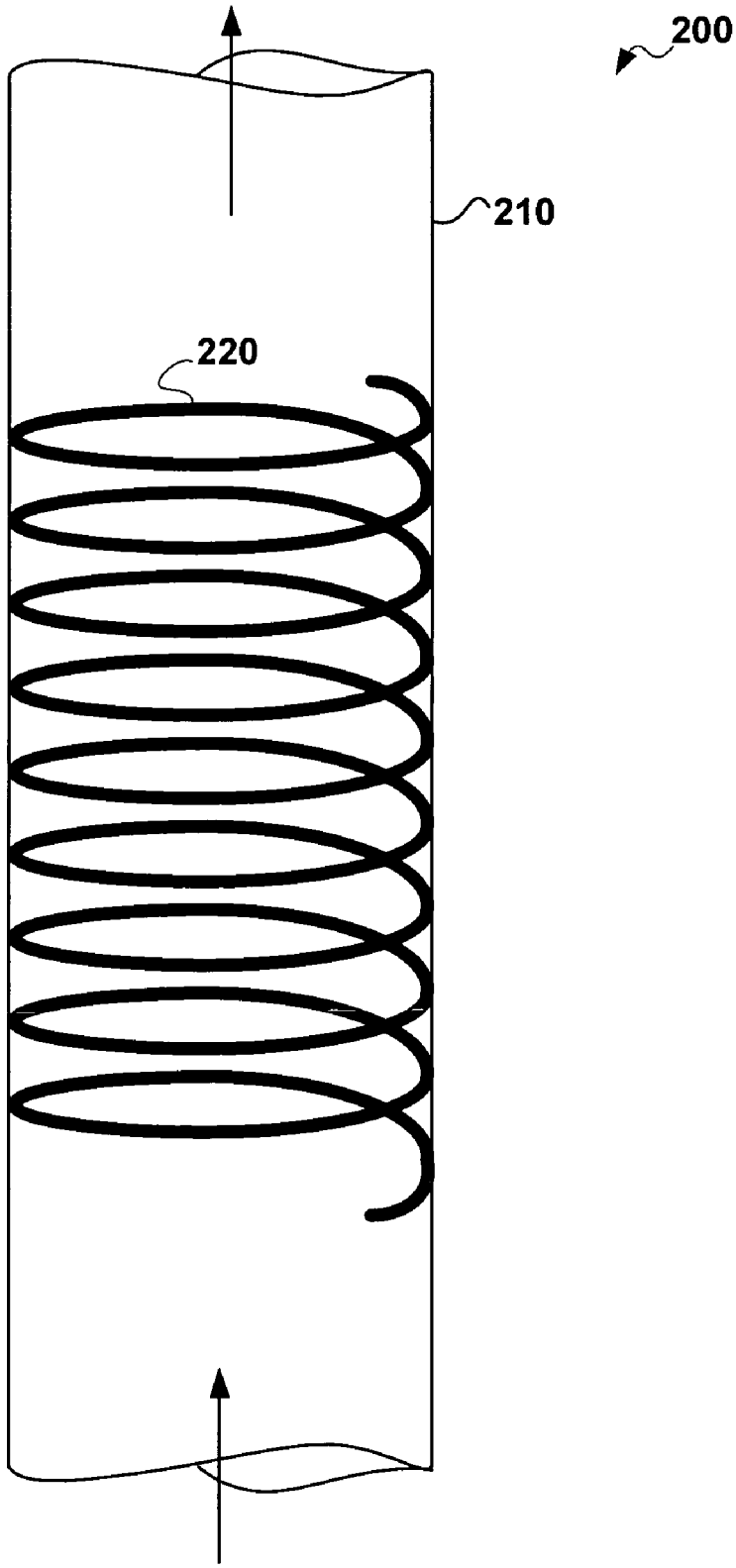
FIG. 2 depicts a system for burning particles in an exhaust system in accordance with another embodiment of the invention.

FIG. 2 depicts an exhaust system 200 comprising a combustion chamber 210 and a radiation source 220. In exhaust system 200, the radiation source 220 is disposed within the combustion chamber 210. The radiation source 220, as shown, comprises a coiled resistive heating element. As above, the radiation source 220 can take other shapes and, for example, can be longitudinally disposed internally along the length of the combustion chamber 210. In those embodiments in which the radiation source 220 is disposed within the combustion chamber 210, radiation from the radiation source 220 can directly heat the particles in the exhaust as well as heat the walls of the combustion chamber 210 as in the embodiment of FIG. 1. While the direct heating of the particles is more energy efficient, placing the radiation source 220 within the combustion chamber 210 disadvantageously exposes the radiation source 220 to the high-temperature exhaust gases.

Figure 3:
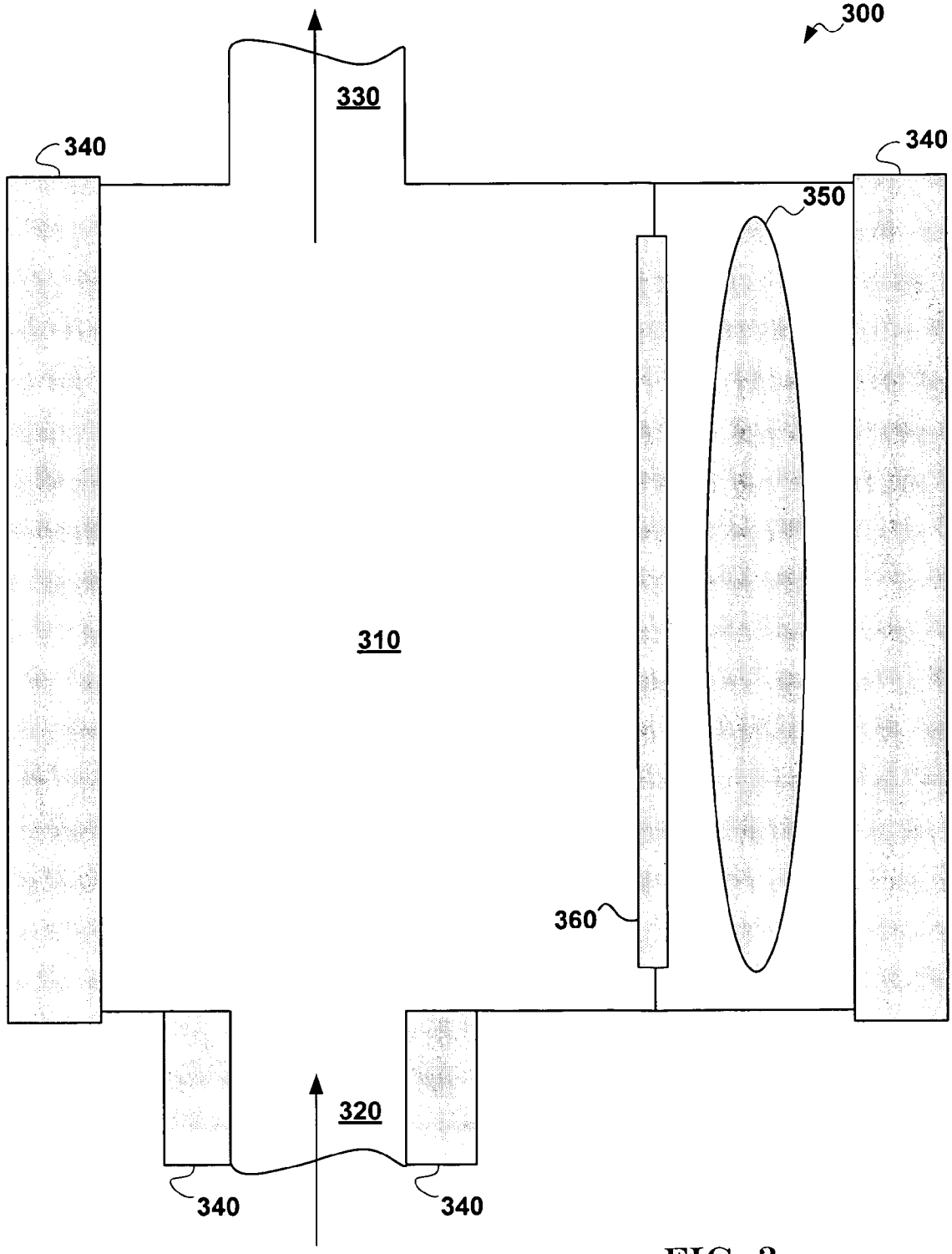
FIG. 3 depicts a system for burning particles in an exhaust system in accordance with another embodiment of the invention.

FIG. 3 depicts an exhaust system 300 comprising a combustion chamber 310 having an inlet 320 and an outlet 330, optional thermal insulation 340, a radiation source 350, and a radiation transparent window 360 into the combustion chamber 310. In the illustrated embodiment, a diameter of the combustion chamber 310 is greater than a diameter of the inlet 320. This arrangement slows the exhaust gas as it enters the combustion chamber 310 and can create a muffling effect.

In some embodiments, the inlet 320 and/or the combustion chamber 310 are thermally insulated by the thermal insulation 340 to retain as much heat as possible in the exhaust gas as the gas enters the combustion chamber 310. It will be appreciated that insulation 340 can be similarly applied to the other embodiments disclosed herein. For example, a blanket of insulation 340 can be wrapped around the radiation source 120 and combustion chamber 110 of FIG. 1.

Radiation source 350 can be, for example, a coherent or incoherent IR emitter or microwave emitter, such as a Klystron tube. Unlike a resistive heating element, radiation source 350 can be configured to emit radiation directionally and/or within a desired range of wavelengths. Accordingly, radiation transparent window 360 is provided to allow radiation to pass directly into the combustion chamber 310. In some embodiments, the radiation transparent window 360 extends completely around the circumference of the combustion chamber 310.

As noted, radiation source 350 can be tuned to produce radiation within a desired range of wavelengths. Thus, the radiation can be tuned to excite specific molecular bonds that are known to be present in the particles of the exhaust stream. For example, microwave radiation can be tuned to excite carbon-hydrogen bonds or carbon-carbon bonds where the particles in the exhaust are known to include such bonds. Tuning the radiation in this manner can heat particles to their ignition temperature more quickly and with less energy.

The radiation transparent window 360 is constructed using a material that can withstand the heated exhaust gases within the combustion chamber 310. In some embodiments, radiation transparent window 360 is a microwave transparent window constructed using fiberglass, plastic, polycarbonate, quartz, porcelain, or the like. In other embodiments, the radiation transparent window 360 is an IR transparent window constructed using, for instance, sapphire.

Figure 4:
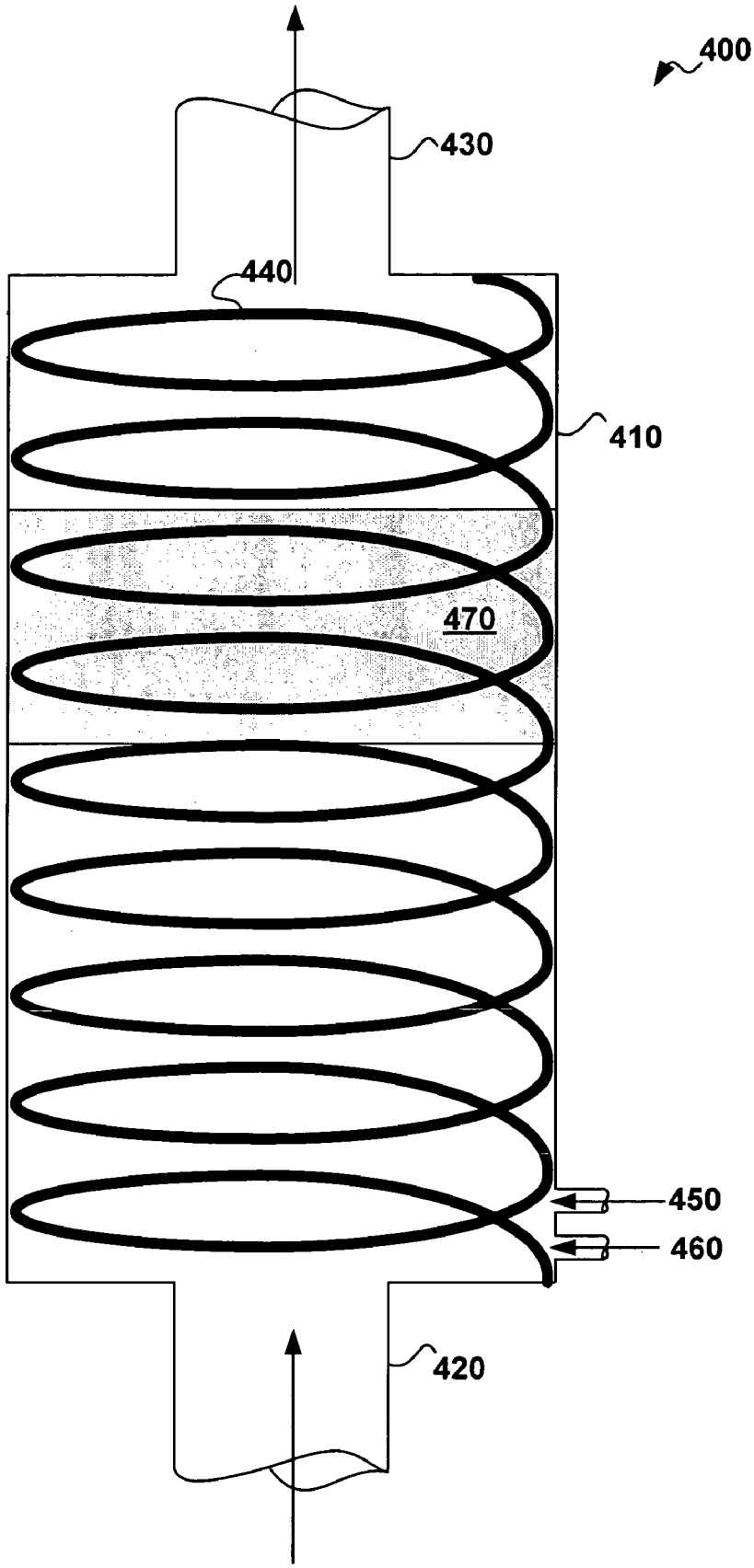
FIG. 4 depicts a system for burning particles in an exhaust system in accordance with another embodiment of the invention.

FIG. 4 depicts an exhaust system 400 to illustrate other optional components that can be employed in conjunction with any of the preceding embodiments. Exhaust system 400 comprises a combustion chamber 410 having an inlet 420 and an outlet 430, a radiation source 440, an air inlet 450, a fuel inlet 460, and a catalyst 470. As in the previous example, the combustion chamber 410 can have a greater diameter than the inlet 420 and the outlet 430. Alternatively, the outlet 430 can have the same diameter as combustion chamber 410. The radiation source 440, as shown, is a resistive heating element disposed within the combustion chamber 410, but can alternatively be disposed externally and can alternatively be an IR or microwave emitter.

The combustion chamber 410 may comprise air intake 450 and/or fuel intake 460. In some embodiments, air intake 450 is configured to introduce oxygen to the combustion chamber to aid the combustion reaction in the event that there is not enough oxygen present in the exhaust as it enters the combustion chamber 410. In other embodiments, fuel intake 460 introduces fuel into the combustion chamber to burn and, thus, heat the exhaust as it enters through inlet 420. It will be appreciated that adding fuel with or without air can, in some instances, replace the need for a radiation source. In such embodiments, a spark generator or other ignition source can be employed to ignite the combustion reaction with the added fuel.

In certain embodiments, the combustion chamber 410 additionally comprises at least one catalyst 470 to catalyze oxidation and/or reduction reactions in the exhaust stream. The catalyst 470 can include platinum, rhodium, and/or palladium deposited on a honeycomb substrate or ceramic beads. In these embodiments, the combustion chamber 410 is configured to additionally function as a catalytic converter in the exhaust system 400. It will be understood that heating the exhaust gas in the presence of the catalyst 470 can advantageously improve the completeness of the reaction being catalyzed.

Figure 5:
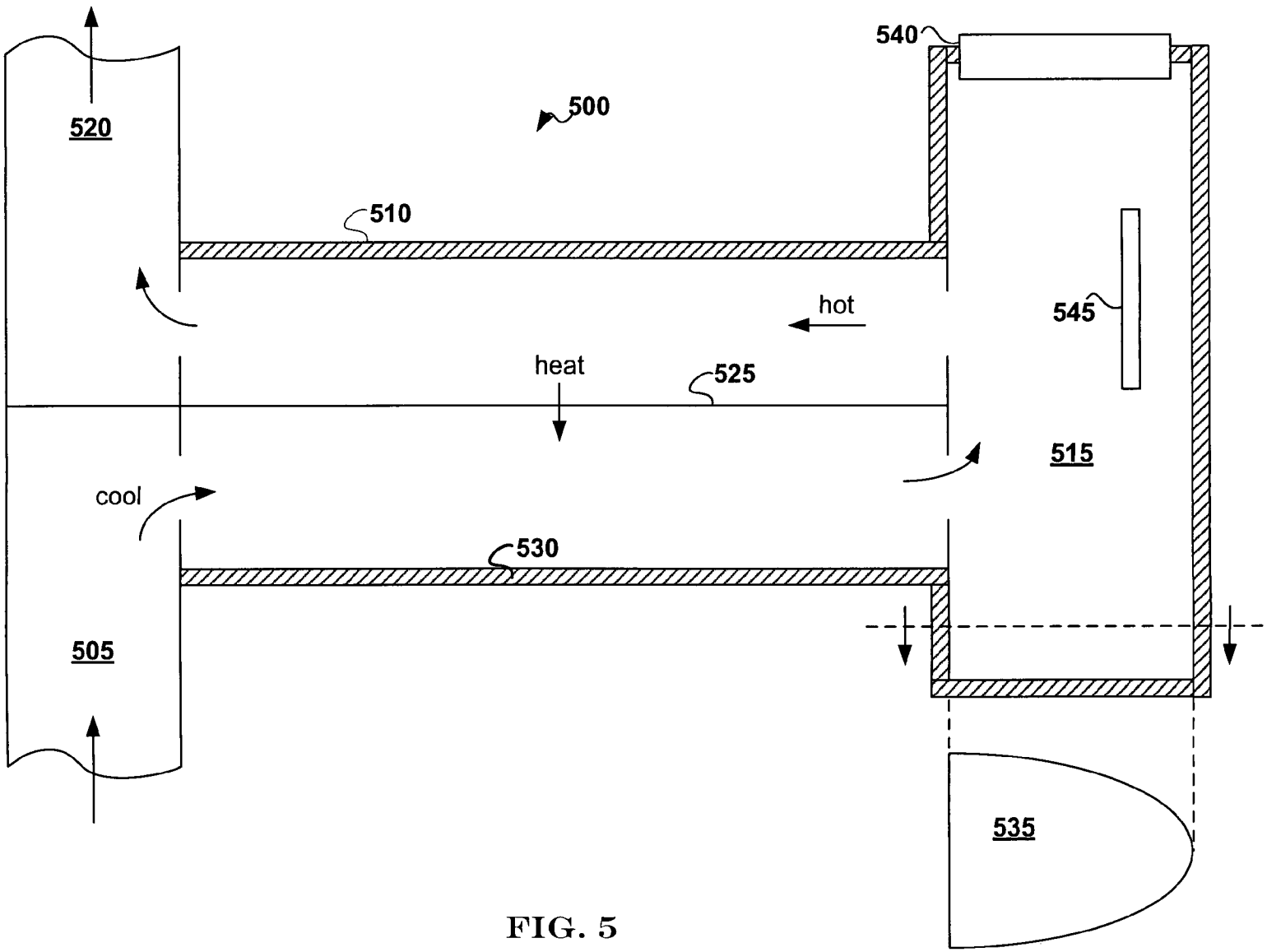
FIG. 5 depicts a cross sectional view of the system for burning particles further comprising a reverse flow heat exchanger in accordance with one embodiment of the invention.

FIG. 5 depicts an exhaust system 500 comprising an inlet 505, a heat exchanger 510, a combustion chamber 515, and an outlet 520. The heat exchanger 510 serves to pre-heat the exhaust before the exhaust enters the combustion chamber 515. The heat exchanger 510 can also serve as a muffler, in some embodiments. Heat exchanger 510 is separated into two or more sections by at least one wall 525. Exhaust enters the exhaust system 500 via the inlet 505 and is directed into one section of the heat exchanger 510. Heated gases exiting the combustion chamber 515 through another section of the heat exchanger 510 transfer heat to the incoming gases through the wall 525. In some embodiments, the heat exchanger 510 and/or the combustion chamber 515 are insulated by thermal insulation 530. As in other embodiments described herein, the inlet 505 can also be thermally insulated.

In some embodiments, the combustion chamber 515 has a parabolic or partially parabolic cross-section 535 perpendicular to a longitudinal axis to create a hot zone. The combustion chamber 515 also comprises a radiation source 540. In some embodiments, the radiation source 540 is a microwave emitter, such as a Klystron tube. Alternatively, radiation source 540 is an IR emitter. In some embodiments, a radiation transparent window separates the radiation source 540 from the combustion chamber 515.

In some embodiments, the combustion chamber 515 further comprises at least one catalyst 545 configured to catalyze oxidation and/or reduction reactions of undesirable gases in the exhaust stream such as $NO_x$ compounds. In those embodiments where the heat exchanger 510 is configured to act as a muffler, and the combustion chamber 515 comprises catalyst 545, it will be appreciated that the exhaust system 500 can replace both the muffler and the catalytic converter in a conventional vehicle exhaust system. Advantageously, because the combustion chamber 515 burns the particles present in the exhaust stream, it will be further appreciated that the exhaust system 500 can additionally replace a particle trap in a conventional vehicle exhaust system. One of skill in the art will also recognize that the exhaust systems disclosed herein can also be applied to clean exhaust streams from non-vehicular sources such as power plants, fireplace chimneys, industrial and commercial processing, and the like.

It should be noted that in some embodiments the catalyst 545 comprises a substrate, such as a grating, with a surface coating of a catalytic material that is placed over an opening 550 of the heat exchanger 510. While such a catalyst 545 may at least partially restrict the flow of exhaust gas through the combustion chamber 515, the catalyst is not a particle trap or filter. Specifically, openings in the grating are too large to trap or filter the particles in the exhaust entering the chamber 515. Additionally, such a catalyst 545 cannot collect particles for two reasons. First, particles are eliminated from the exhaust before the exhaust reaches the opening 550. Second, even if a particle survives the combustion reaction and adheres to the catalyst 545, the restriction around the particle would cause a local increase in temperature which would cause the particle to burn and not be retained thereon.

Likewise, some embodiments that employ a microwave emitter as the radiation source 540 include a microwave-blocking grating (not shown) either across the opening 550 or further downstream along the exhaust path to prevent microwaves from propagating out of the exhaust system 500. For essentially the reasons discussed above, although such a microwave-blocking grating may at least partially restrict the flow of exhaust gas through the combustion chamber 515, the microwave-blocking grating is not a particle trap or filter. The openings of the grating are too large to trap or filter particles in the exhaust, particles are eliminated from the exhaust before the exhaust reaches the microwave-blocking grating, and any particles that survive and adhere to the microwave-blocking grating simply burn off.

Figure 6:
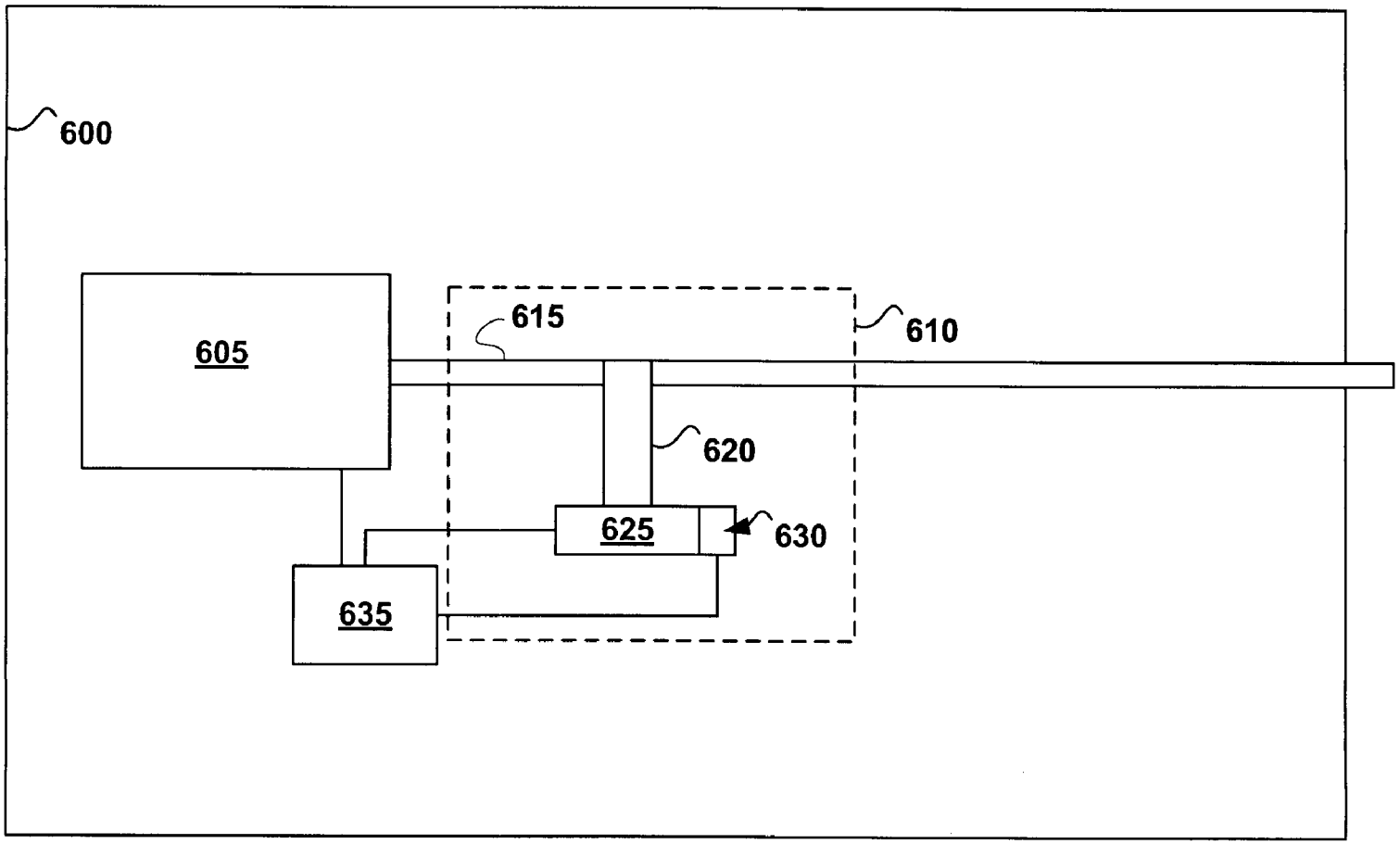
FIG. 6 depicts a schematic representation of a vehicle comprising an internal combustion engine and an exhaust system in accordance with another embodiment of the invention.

FIG. 6 shows a schematic representation of a vehicle 600 comprising an internal combustion engine 605 such as a diesel engine. The vehicle 600 also comprises an exhaust system 610 that includes an exhaust pipe 615 from the engine 605 to a reverse flow heat exchanger 620, a combustion chamber 625, and a radiation source 630. The vehicle 600 further comprises a controller 635 for controlling the power to the radiation source. The controller 635 can be coupled to the engine 605 so that no power goes to the radiation source 630 when the engine is not operating, for example. The controller 635 can also control the radiation source 630 in a manner that is responsive to engine 605 operating conditions. Further, the controller 635 can also control the radiation source 630 according to conditions in the combustion chamber 625. For instance, the controller 635 can monitor a thermocouple in the combustion chamber 625 so that no power goes to the radiation source 630 when the temperature within the combustion chamber 625 is sufficiently high to maintain a self-sustaining combustion reaction.

An additional embodiment of the invention is an air purifier such as for a hospital room, a clean room, a factory, an office, a residence, or the like. An exemplary air purification system comprises a combustion chamber and a means for heating particles in the air to at least an ignition temperature within the chamber. A reverse flow heat exchanger is wrapped around the combustion chamber to recycle excess heat from the exiting air to the entering air. The means for heating can be a radiation source, an open flame, or both.

Unlike the exhaust systems described previously herein, these embodiments are designed for environments in which the concentration of particles in the incoming air is low. Therefore, in embodiments that employ a radiation source, the radiation source is typically run constantly to maintain the combustion of the particles. Additionally, or alternatively, a fuel can be supplied to the combustion chamber to compensate for the lower concentration of particles. Like the prior exhaust systems, this further air purifier requires little to no maintenance and is self-cleaning. Advantageously, some embodiments of the air purifier do not require a radiation source or a fan to maintain air movement and therefore do not require electricity.

Figure 7:
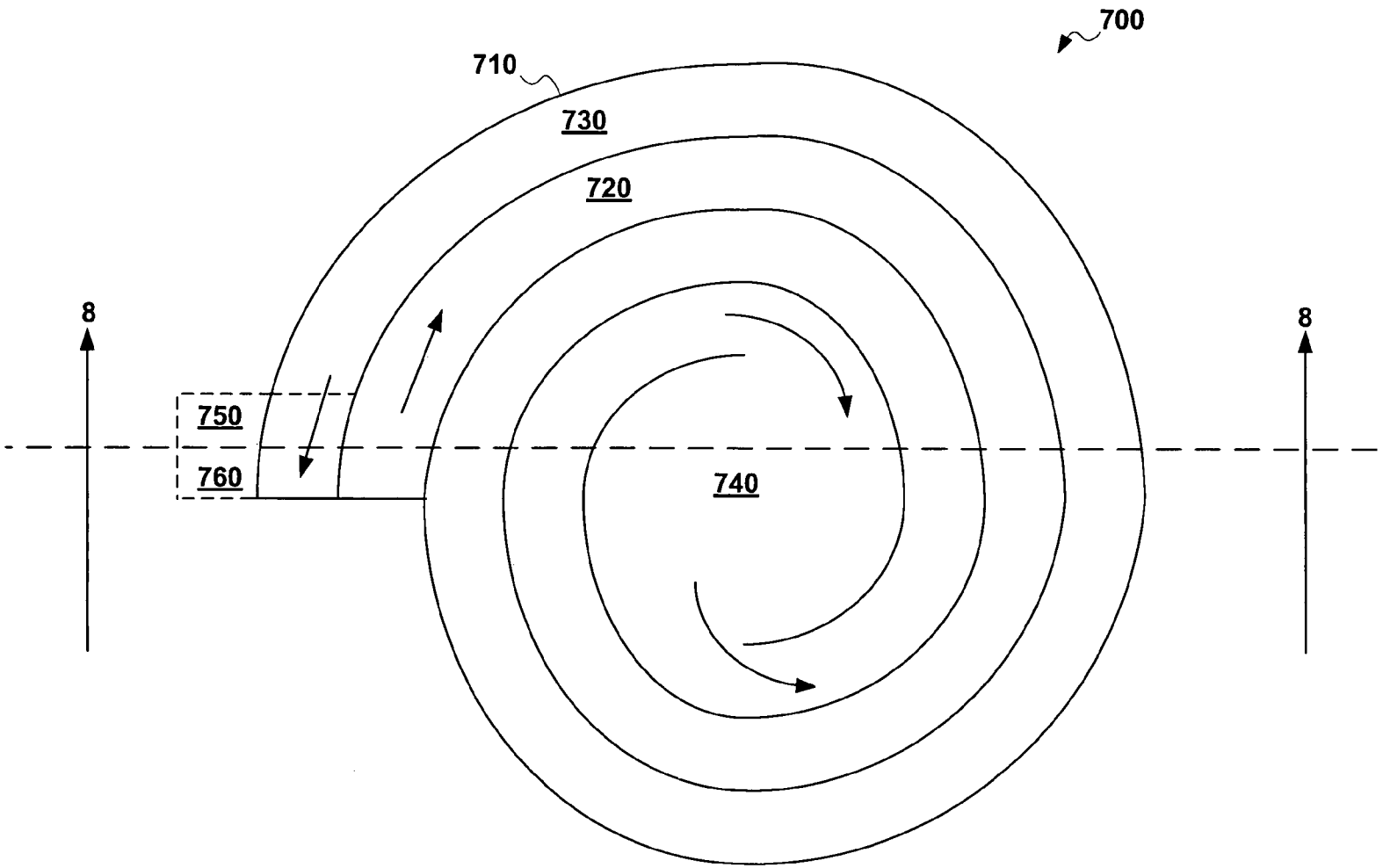
FIG. 7 depicts a cross sectional view taken perpendicular to a vertical axis of an exemplary spiral reverse flow heat exchanger and combustion chamber in an air purification system in accordance with one embodiment of the invention.

FIG. 7 depicts a cross sectional view of an air purification system 700. The cross section depicted is taken perpendicular to a vertical axis of the air purification system 700. A reverse flow heat exchanger 710 comprises two ducts, an incoming duct 720 and an outgoing duct 730 coiled around a combustion chamber 740. The air purification system 700 also comprises an inlet 750 and an outlet 760 shown in dashed lines to represent that these components are out of the plane of the drawing. The inlet 750 is an opening through which particle-laden air enters the incoming duct 720 of the reverse flow heat exchanger 710. The outlet 760 is an opening through which substantially particle-free air leaves the outgoing duct 730 of the reverse flow heat exchanger 710. Typically, the reverse flow heat exchanger 710 and the combustion chamber 740 are constructed using stainless steel, but other suitable materials will be familiar to those skilled in the art.

The reverse flow heat exchanger 710 transfers heat from the air exiting the combustion chamber 740 to the particle-laden air entering the combustion chamber 740. After the particle-laden air enters the combustion chamber 740, the particles are burned and the air exits the combustion chamber 740 substantially particle-free. As particles, including dust, biological toxins, and the like, typically combust at about 800° C., the exiting air is significantly warmer than room temperature. The excess heat is transferred from the exiting air to the entering air through the walls of the reverse flow heat exchanger 710 to preheat the particle-laden air. The heat exchanger 710 also acts as insulation for the combustion chamber 740, making the air purification system 700 safer and more energy efficient.

In some embodiments, an optional fan (not shown), can be placed at the inlet 750 and/or the outlet 760 to improve air flow through the air purification system 700. At the outlet 760, for instance, the fan draws air out from the air purification system 700. The fan can be run continuously, periodically, or when the air purification system 700 is first activated. The fan can be connected to a control circuit described herein.

Figure 8:
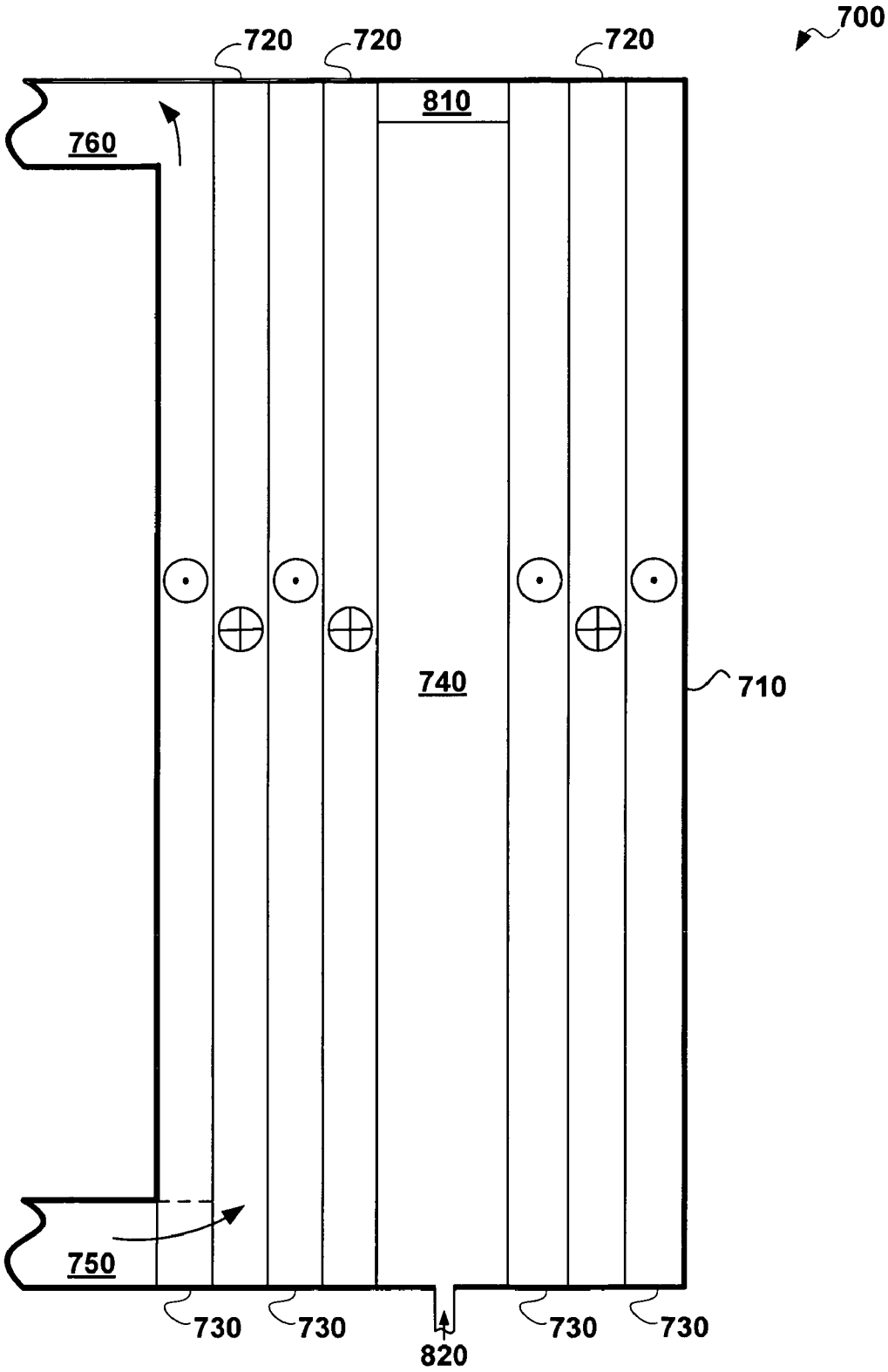
FIG. 8 depicts a cross sectional view along a vertical axis of the air purification system in accordance with one embodiment of the invention.

FIG. 8 depicts a cross sectional view of the air purification system 700 along a line 8-8 as noted in FIG. 7. The reverse flow heat exchanger 710 includes an inlet 750 and an outlet 760. An incoming duct 720 is depicted using an arrow pointing into the page. An outgoing duct 730 is depicted using an arrow pointing out of the page. The inlet 750 and the outlet 760 are typically located at opposite ends of the air purifier 700.

In some embodiments, the air purification system 700 has a height dimension approximately equal to the height of a room in which the air purification system 700 will be installed. Accordingly, the inlet 750 can be near the floor while the outlet 760 can be near the ceiling, or vice-versa. This height ensures that most of the air in the room circulates through the air purification system 700. Other dimensions, including the number of windings, the spacings between the walls, and the like can be determined by one skilled in the art.

The air purification system 700 also includes means for heating particles. The means for heating particles can be disposed near the top of the combustion chamber 740 or in another location, such as the bottom of the combustion chamber 740. The means for heating particles heats the particles in the combustion chamber 740 to at least an ignition temperature. The air purification system 700 may additionally include a control circuit (not shown) to monitor and control the combustion and flow rate through the air purification system 700.

The means for heating particles can be a radiation source 810, an open flame, or both. For example, as a radiation source 810, the means can be a microwave emitter such as a Klystron tube. The radiation can be tuned to excite specific molecular bonds that are known to be present in the particles in the air. For example, microwave radiation can be tuned to excite carbon-hydrogen bonds or carbon-carbon bonds where the particles in the exhaust are known to include such bonds. Tuning the radiation in this manner can heat particles to their ignition temperature more quickly and with less energy. As described herein, for example in the description of FIG. 3, the microwave emitter can be positioned behind a microwave transparent window. The radiation source 810 can also be a resistive heating element such as radiation source 120 (FIG. 1) vertically disposed within the combustion chamber 740. In some embodiments, such a resistive heating element is a straight length running the height of the combustion chamber 740, rather than the coil depicted in FIG. 1.

Alternatively, the means for heating particles can be a flame. The flame is fueled by fuel entering the combustion chamber 740 via a fuel inlet 820 positioned to inject fuel into the bottom of the combustion chamber 740. Suitable fuels include clean-burning fuels such as propane and butane. The flame is ignited by an igniter (not shown) and burns continuously to heat the particles and the walls of the combustion chamber 740.

The air turnover rate in a room can be varied as needed. An appropriate rate will depend on factors such as the size of the room, air cleanliness requirements for the room, energy efficiency, and the like. For example, in a hospital room or an industrial clean room, where very clean air is required, the air turnover rate can be set significantly higher than in an office where energy efficiency can be more important. The turnover rate can be increased by increasing the flow rate through the air purifier, for example, by increasing the rate at which fuel is burned.

Figure 9:
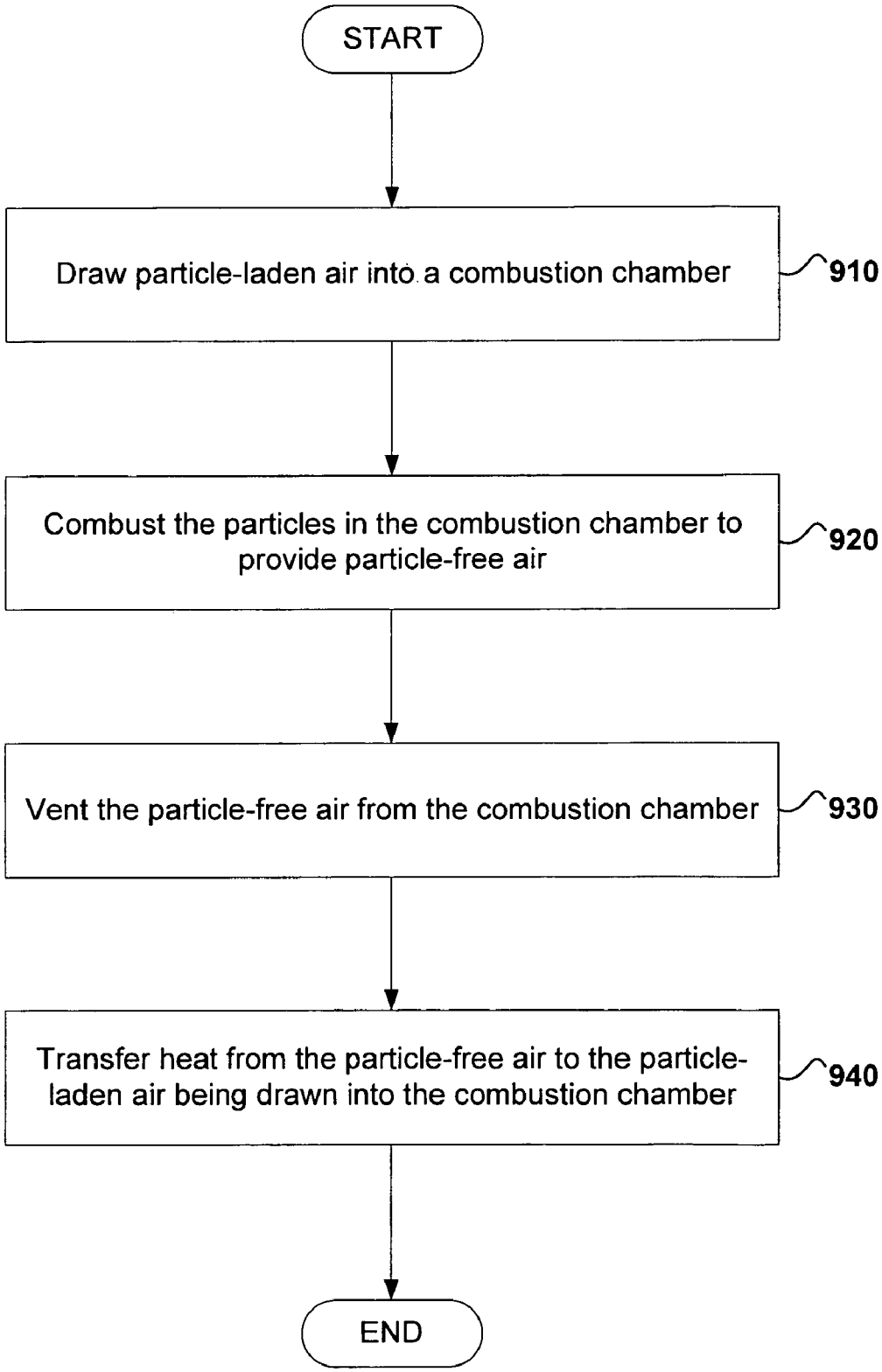
FIG. 9 is a flow chart depicting a method for purifying air in accordance with one embodiment of the invention.

FIG. 9 is a flowchart depicting a method for purifying air. In a step 910, particle-laden air is drawn into a combustion chamber, e.g. combustion chamber 740. The particle-laden air can be drawn in behind the heated rising air in the combustion chamber 740 or by, for example, a fan. In step 920, the particles in the combustion chamber 740 are combusted to provide particle-free air. The combustion reaction is caused by radiation within the combustion chamber 740. A fuel source, such as a propane or butane source can be in fluid communication with the fuel inlet 820. As the fuel mixed with the particle-laden air combusts, the reaction creates heat, further heating other particles to a combustion point. After the combustion reaction, the particle-laden air is substantially particle-free.

In step 930 the particle-free air is vented from the combustion chamber 740. As the heated particle-free air rises and expands, it establishes a circulation through the air purification system 700 which forces the particle-free air out of the combustion chamber 740 and through the outgoing duct 730, venting the air. Additionally, a fan can assist the venting of the air. In step 940, heat from the particle-free air is transferred to the particle-laden air being drawn into the combustion chamber 740. This step can be performed using, e.g. heat exchanger 710. By transferring heat from the particle-free air to the particle laden air, the particle-laden air is pre-heated prior to combustion which results in greater overall energy efficiency.

In the foregoing specification, the present invention is described with reference to specific embodiments thereof, but those skilled in the art will recognize that the present invention is not limited thereto. Various features and aspects of the above-described present invention may be used individually or jointly. Further, the present invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. An air purification system, comprising:

a combustion chamber including a fuel inlet configured to supply fuel to the combustion chamber; and a reverse flow heat exchanger including first and second ducts each in fluid communication with the combustion chamber, the ducts being spiral-wound around the combustion chamber.

2. The air purification system of claim 1 wherein the combustion chamber includes an igniter arranged with respect to the fuel inlet so as to be able to ignite the fuel.

3. An air purification system, comprising:

a reverse flow heat exchanger including first and second ducts each in fluid communication with a combustion chamber, the ducts being spiral-wound around the combustion chamber; and a radiation source for heating particles to an ignition temperature and arranged with respect to the combustion chamber so as to be able to produce radiation within the combustion chamber.

4. The air purification system of claim 3 wherein a height dimension of the heat exchanger is approximately a room height.

5. The air purification system of claim 3 wherein the combustion chamber includes a fuel inlet.

6. The air purification system of claim 3 wherein the radiation source comprises a microwave emitter and the combustion chamber includes a microwave transparent widow configured to allow radiation from the microwave emitter to pass into the combustion chamber.

7. The air purification system of claim 6 wherein the microwave emitter is tuned to excite a molecular bond.

8. The air purification system of claim 3 wherein the radiation source comprises a resistive heating element disposed within the combustion chamber.

* * * * *